United States Patent [19]

Winschel, deceased et al.

[11] Patent Number: 4,504,217

[45] Date of Patent: Mar. 12, 1985

[54] LOW EXCESS AIR BURNER HAVING A MOVABLE VENTURI

[75] Inventors: Richard E. Winschel, deceased, late of Erie, by Marie A. Winschel, administratrix; Fred B. Heil, Cambridge Springs; Robert V. Seibel, Erie, all of Pa.

[73] Assignee: Zurn Industries, Inc., Erie, Pa.

[21] Appl. No.: 541,889

[22] Filed: Oct. 14, 1983

[51] Int. Cl.[3] ..... F23M 9/00

[52] U.S. Cl. ..... 431/183; 431/186; 431/188

[58] Field of Search ..... 431/183, 184, 185, 186, 431/188, 284, 157, 189; 60/751; 110/264; 239/401, 402, 406, 420, 423, 525

[56] References Cited

U.S. PATENT DOCUMENTS

| | | | |
|---|---|---|---|
| 2,325,444 | 7/1943 | Vroom et al. | 431/186 |
| 2,485,656 | 10/1949 | Raskin | 431/186 X |
| 3,349,826 | 10/1967 | Poole et al. | 431/183 |
| 4,400,151 | 8/1983 | Vatsky | 431/188 X |

FOREIGN PATENT DOCUMENTS

| | | | |
|---|---|---|---|
| 362767 | 10/1929 | Fed. Rep. of Germany | 431/186 |
| 193172 | 12/1937 | Sweden | 431/186 |

*Primary Examiner*—Randall L. Green
*Attorney, Agent, or Firm*—Wayne L. Lovercheck; Charles L. Lovercheck; Dale R. Lovercheck

[57] ABSTRACT

A low excess air burner having a venturi shaped insert in the burner housing to create an even air distribution across the burner throat opening. The venturi shaped insert is adjustable through a predetermined range of positions to control the flame shape and length at high loads and to trim the air flow at low loads. An offset or step in the burner throat creates a turbulent recirculation zone to stabilize the flame front and to hold ignition within the burner arch. A spinner defuser is provided at the open end of the burner housing to impart a rotary motion to the air to provide fuel air mixing and stabilizing of the flame front to aid ignition. Air inlets are surrounded with a housing and have a perforated plate shield covering them providing a smooth evenly distributed air supply to the burner housing. All fuel air mixing occurs at the open end of the burner and is contained in the refractory throat to eliminate premature ignition in the burner housing.

20 Claims, 9 Drawing Figures

LOW EXCESS AIR BURNER HAVING A MOVABLE VENTURI

BACKGROUND OF THE INVENTION

This invention relates to an improved low excess air burner having a movable venturi in the burner throat, air inlets distributed generally about the entire circumference of the burner, and having air flow distributing means in the air inlets. The movable venturi, air inlet and air flow distributing means act to create a smooth air flow and an even air distribution across the burner throat opening.

The movable venturi shaped insert is adjustable through a predetermined range of positions to control the flame shape and length at high loads and to trim the air flow at low loads. The burner housing has been provided with a construction in the form of an annular insert forming a hollow cylinder along a middle section and expanding frustoconically forwardly and rearwardly to the size of the burner housing in a front section and a rear section respectively.

Tapered throats in burner housings have been known in the art for some time. An example of a burner having a tapered throat is discussed in Reid et al, U.S. Pat. No. 3,940,234 which utilizes a tapered throat construction 58 at the input end of the burner tube 24 which provides a narrowing throat portion which narrows to a diameter 29, has a front expanding portion 33, and a rear expanding portion which does not increase to the size of the burner housing thus providing a step or offset at the position where air is admitted to the burner housing. Due to the step at this position, the air and high velocity gas are mixed turbulently in the venturi portion of the burner tube and turbulent flow is maintained throughout the burner housing. The venturi is constructed to cause and maintain turbulent flow, not to maintain a smooth, evenly distributed flow throughout the length of the burner tube as in the present invention. Furthermore, the Reid Patent does not contemplate moving the venturi to adjust the flame front. For different burn rates and varying conditions, the optimum position for the venturi will vary. To maintain a smooth, evenly distributed flow throughout the burner housing as contemplated by the applicant, it is necessary to move the venturi to maintain a smooth, evenly distributed flow, to trim the flame shape and length at high loads and to trim the air flow at low loads.

It has been known in the art to slide a sleeve over air openings admitting air to the burner throat to restrict air flow therethrough and to move such sleeves with rods attached thereto which extend rearwardly through the rear wall of the burner, as shown by Peterson et al, U.S. Pat. No. 3,904,349. The Peterson patent discloses the positioning rods 64 which position the sleeve 60 and the positioning rod 64A which positions the sleeve 82.

A drawback to the fuel burners known in the art is that the burners have been located where the air around the air inlet is irregular in pressure and velocity and therefore an irregular flow of air is admitted through the air inlet to the burner housing. Applicant has determined that it is desirable to admit a smooth, evenly distributed supply of air to the burner and thus there is a need to provide air inlets with an inlet housing and perforated plate shield to insure that a smooth, evenly distributed air supply enters the burner housing.

SHORT STATEMENT OF THE INVENTION

Accordingly the present invention relates to an improved low excess air burner. Burners known in the art are intended to operate with as little as 10% to 15% excess air. The present invention operates with less than 5% excess air providing a more efficient burner which produces smaller quantities of undesirable combustion byproducts. The low excess air burner consists of a cylindrical burner housing having a first end which is open and positioned adjacent the refractory burner arch throat. The second end is closed and may have provision for the passage of fluid fuels therethrough. A venturi is located within the burner housing and is movable through a predetermined range to create an even air distribution across the burner throat opening and to control the flame shape and length at high loads as well as to trim the air flow at low loads. The flame is observable through observation ports located on the rear wall of the burner housing.

Air inlets may be distributed around the burner housing near the second end 16 thereof or a continuous air inlet extending entirely around the burner housing near the second end 16 thereof may be provided. Each air inlet or the continuous air inlet may be surrounded by an inlet housing which creates a passageway leading from the exterior into the inside of the burner housing. A perforated plate shield covers the air inlet or air inlets over the inlet housing or inlet housings and ensures that a smooth evenly distributed air supply enters the burner housing.

The refractory throat adjacent the first end of the burner is adapted to withstand the temperatures of combustion and all fuel air mixing is done adjacent the first end of the burner housing within the refractory throat to eliminate the possibilities of premature ignition in the burner housing.

A step or offset in the burner throat creates a turbulent recirculation zone to stabilize the flame front and hold ignitition within the burner arch.

The inlet housing and perforated plate shield acts in conjunction with the adjustable venturi to maintain a smooth, evenly distributed flow of air throughout the length of the burner housing. Adjacent the first end of the burner housing, a spinner defuser which may comprise a series of blades inclined to the air flow through the burner housing imparts a rotary motion to the moving air mass which trips the flow to turbulent and provides for good fuel air mixing and furthermore stabilizes the flame front for good ignition.

It therefore is an object of this invention to provide an improved low excess air burner which has a movable venturi shaped insert in the burner housing to create an even air distribution across the burner throat opening.

It is a further object of the invention to provide an offset or step in the burner throat to create a turbulent recirculation zone to stabilize the flame front and to hold ignition within the burner arch.

It is a further object of the invention to provide a spinner defuser at the open end of the burner housing to impart a rotary motion to the air to provide fuel air mixing and stabilizing of the flame front to aid ignition.

It is another object of the invention to cover air inlets with an inlet housing having a perforated plate shield to provide a smooth evenly distributed air supply to the burner housing.

It is a further object of the invention to provide for all fuel air mixing to occur at the open end of the burner and to contain all such fuel air mixing in the burner throat to eliminate premature ignition in the burner housing.

With the above and other objects in view, the present invention consists of the combination and arrangement of parts hereinafter more fully described, illustrated in the accompanying drawing and more particularly pointed out in the appended claims, it being understood that changes may be made in the form, size, proportions, and minor details of construction without departing from the spirit or sacrificing any of the advantages of the invention.

BRIEF DESCRIPTION OF THE DRAWINGS

Other objects, features, and advantages of the present invention will become more fully apparent from the following detailed description of the preferred embodiments, the appended claims, and the accompanying drawings in which:

DESCRIPTION OF THE PREFERRED EMBODIMENTS

Figure 7:
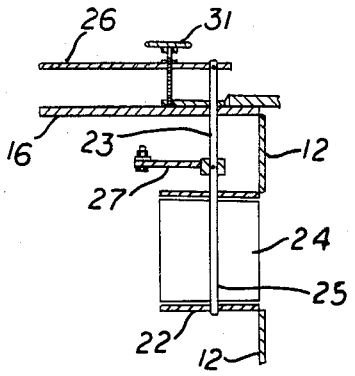
FIG. 7 is a cross sectional side view of the louver operating mechanism taken on line 7—7 of FIG. 2.
Figure 8:
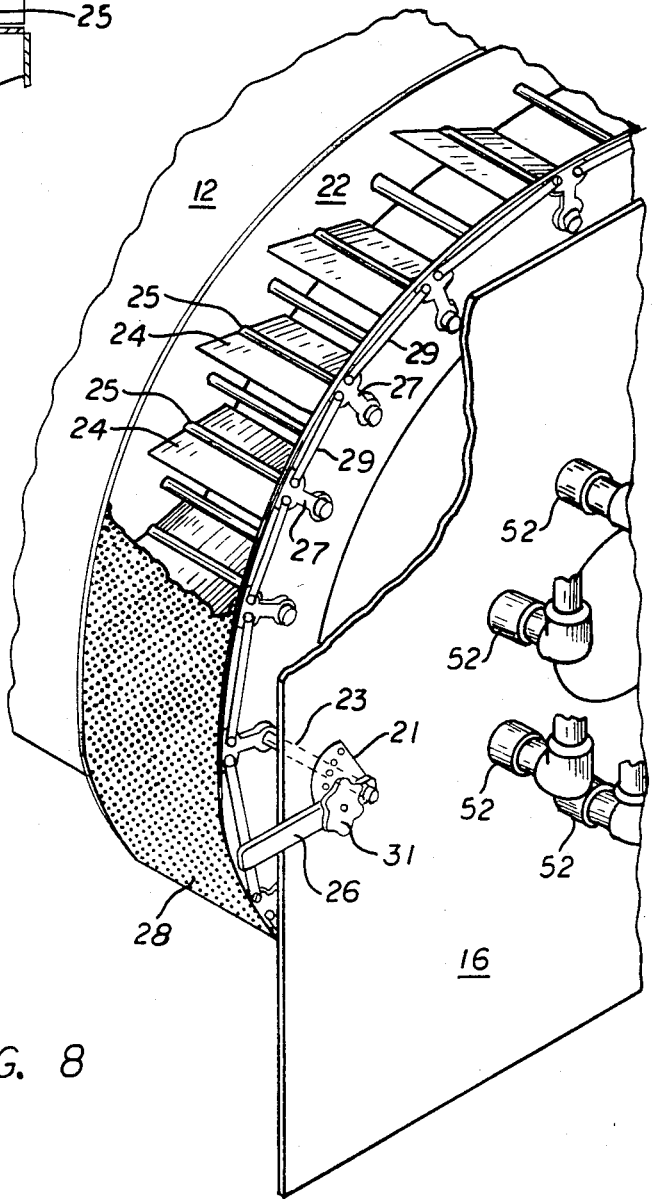
FIG. 8 is an isometric view of a preferred embodiment of the low excess air burner of the present invention showing the perforated plate shield, and partly broken away to show the louvers and the lever mechanism which opeates the louvers; and, FIG. 9 is a plane view of a portion of the perforated plate shield according to a preferred embodiment of the invention.

The preferred embodiment of the present invention is illustrated by way of example in FIGS. 1-7. With particular reference to the low excess air burner indicated generally at 10, the burner comprises a burner housing 12 which may be cylindrical in shape and positioned with the axis of the cylinder in a horizontal position. The burner housing 12 has a first end 14 which is open and positioned adjacent a refractory burner arch or throat 15. The burner housing has a second end 16 which is closed with a closure plate comprising a plate-like member made of a suitable material. A baffle 18 is provided near the second end 16 which is supported along the inner surface of the burner housing 12 and extends inwardly and forwardly toward the center thereof. Air inlets 20 which comprise air access means may be distributed about the circumference of the burner housing 12 adjacent the second end thereof to admit air to the burner housing. In a preferred embodiment an air inlet 20 may extend continuously about the circumference of the burner housing 12 adjacent the second end thereof to admit air to the burner housing. An inlet housing 22 is affixed adjacent the continuous air inlet 20 providing a passageway into the burner housing from the exterior of the burner housing. Louvers 24 are disposed within the inlet housing and adjustably supported thereon. The louvers 24 are disposed entirely around the circumference of the burner housing within the air inlet and may be adjusted by the control lever 26 to a desired position. Each louver is supported on a louver support member 25 which extends across the air inlet 20 and is rotably supported by the air inlet housing 22 at each of its ends. At least one end of the louver support member extends through the air inlet housing and is rigidly affixed to a crank member 27. The crank members are connected together by a series of links 29. A louver control arm 23 is rigidly attached to the control lever 26 at a first end and may be directly attached to a louver support member 25 as shown in FIGS. 7 and 8, or may be operatively connected thereto by a suitable mechanical arrangement. A louver indexer 21 may be provided which establishes a series of incremental positions for the louver control lever providing a range of positions for the louvers. The louver control lever may be locked in position with the control lock 31. By means of a lever arrangement all of the louvers 24 are adjusted similarly by the control lever 26.

A perforated plate shield 28 having perforations 33 therethrough is disposed over the outer end of the inlet housing to ensure that a smooth, evenly distributed air supply enters the burner housing 12. The Applicant has found that placing a perforated plate shield over the air inlet produces a desirable air flow into the burner housing 12. In a preferred embodiment Applicant has found that a perforated plate shield having approximately 40% holes is preferred.

A movable venturi 30 is supported on wheels 32 and is attached to rods 34 which extend rearwardly through the second end 16. Handles 36 are attached to the ends of the rods 34 outside the burner housing and are adapted to be manually engaged to move the venturi to a predetermined position. The handles are movable to a position 37 indicated in phantom lines. The venturi is made up of a middle portion 38, a rear portion 40, and a front portion 42. The middle portion 38 comprises a hollow cylinder of a diameter less than the inside diameter of the burner housing providing an airway of constant cross section therethrough. The rear section 40 comprises a frustoconical shape which provides an airway of constantly decreasing cross section from the point where air is permitted to enter the housing where the cross sectional area is equal to the inner diameter of the burner housing, to the point where the rear portion meets the middle portion where the cross sectional area is equal to that of the middle portion. The air inlet 20 may be obstructed at least partially by the movable venturi. At the forewardmost position of the movable venturi, that is, when it is closest to the first end of the burner, the air inlet is completely unobstructed by the movable venturi. The movable venturi may be moved rearwardly to the rearwardmost position, that is, when it is closest to the second end of the burner. The air inlet is mostly but not completely obstructed when the movable venturi is in this position. Whatever position the venturi is in, air entering the inlet 20 is immediately subjected to the influence of the decreasing crossectional area of the rear portion of the venturi.

The front portion 42 of the venturi provides a frustoconical shape which provides an airway of gradually and constantly increasing cross section from a point adjacent the middle portion 38 of the movable venturi.

The diameter increases along the length of the front portion of the venturi at a much slower rate than the diameter decreases along the length of the rear portion of the venturi thereby providing a gradual increase of the cross sectional area along the length of the front portion.

An air spinner 44 is positioned adjacent the first end 14 of the burner housing 12. The air spinner 44 is made up of a series of flat, bladed members 46 which are inclined to the direction of the air flow and which radiate outwardly from the center of the burner housing. The air spinner is adapted to trip the air flow to turbulence as it emerges from the first end 14 of the burner housing. The air flow which has been maintained in a smooth and evenly distributed flow throughout the length of the burner housing 12 then enters the refractory throat 15 in turbulent flow where it is mixed with fluid fuel from the fluid fuel supply means indicated at 48, 49, and 52 and burned within the refractory throat 15.

Figure 3:
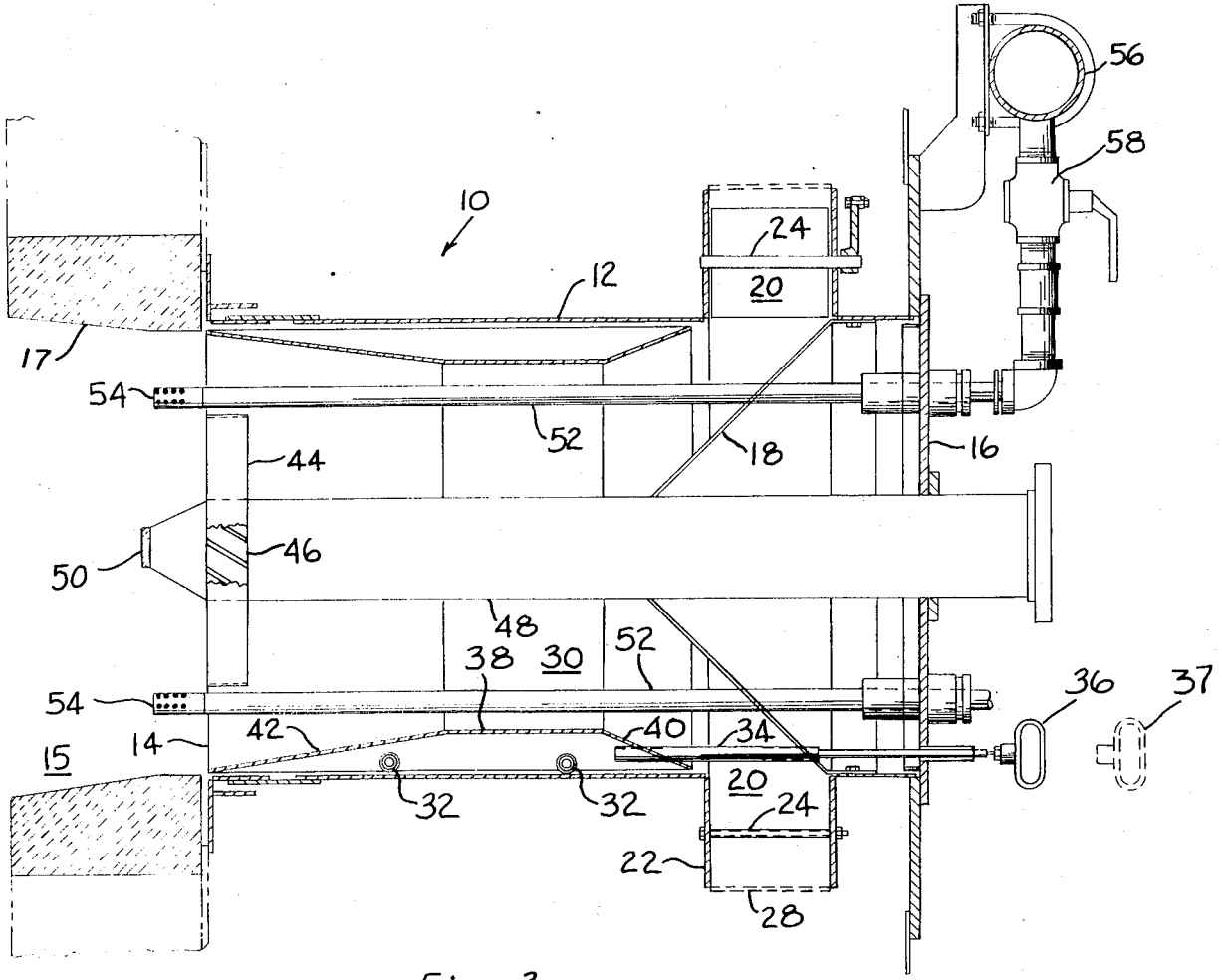
FIG. 3 is a cross sectional side view of a preferred embodiment of the low excess air burner of the present invention taken on line 3—3 of FIG. 2.
Figure 4:
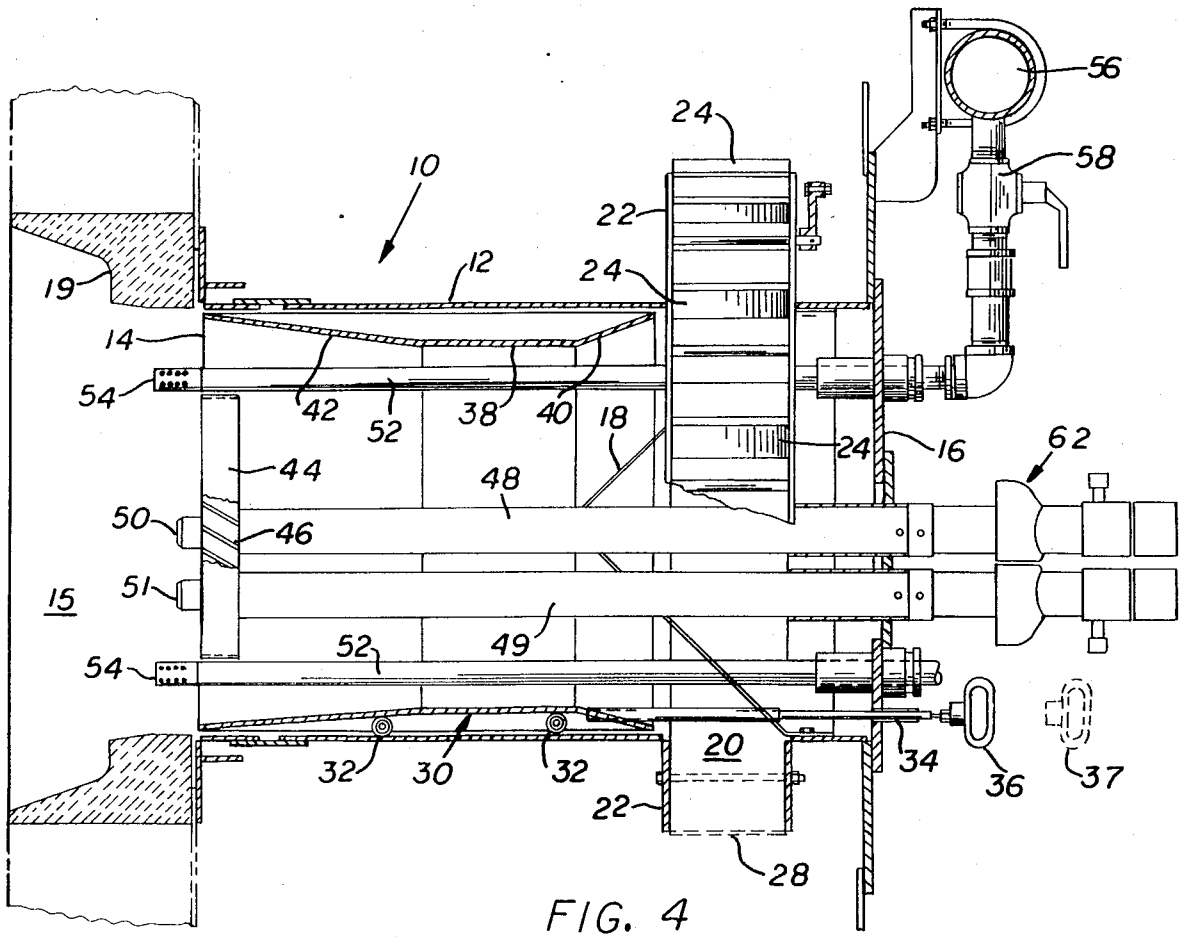
FIG. 4 is a cross sectional side view of another preferred embodiment of the low excess air burner taken on line 3—3 of FIG. 2 and illustrating the use of atomizers for liquid fuel.

An offset 17 as shown in FIG. 3 is provided in the refractory throat 15 to create a turbulent recirculation zone to stabilize the flame front and hold ignition within the refractory throat. In a preferred embodiment a step 19 as shown in FIG. 4 is provided in the refractory throat 15 to create an optimum turbulent recirculation zone for the purpose of stabilizing the flame from and holding ignition within the refractory throat. In this invention all fuel air mixing is done at the first end of the burner near the boiler and is contained within the refractory throat to eliminate the possibilities of premature ignition in the burner housing. The recirculation zone established by the step or offset assures that ignition will occur in the refractory throat.

Referring with particular reference to the low excess air burner illustrated in FIG. 3, first fuel supply means may consist of a pipe 48 located about and extending along the axis of the burner housing 12, entering the second end 16 of the burner housing and protruding beyond the first end 14 of the burner housing terminating at a distal end 50 in the refractory throat 15 which comprises an opening in the refractory wall. The distal end 50 of the first supply pipe 48 is adequately insulated by conventional means known to those skilled in the art which may comprise a half-inch or other suitable thickness of ceramic insulation.

Figure 2:
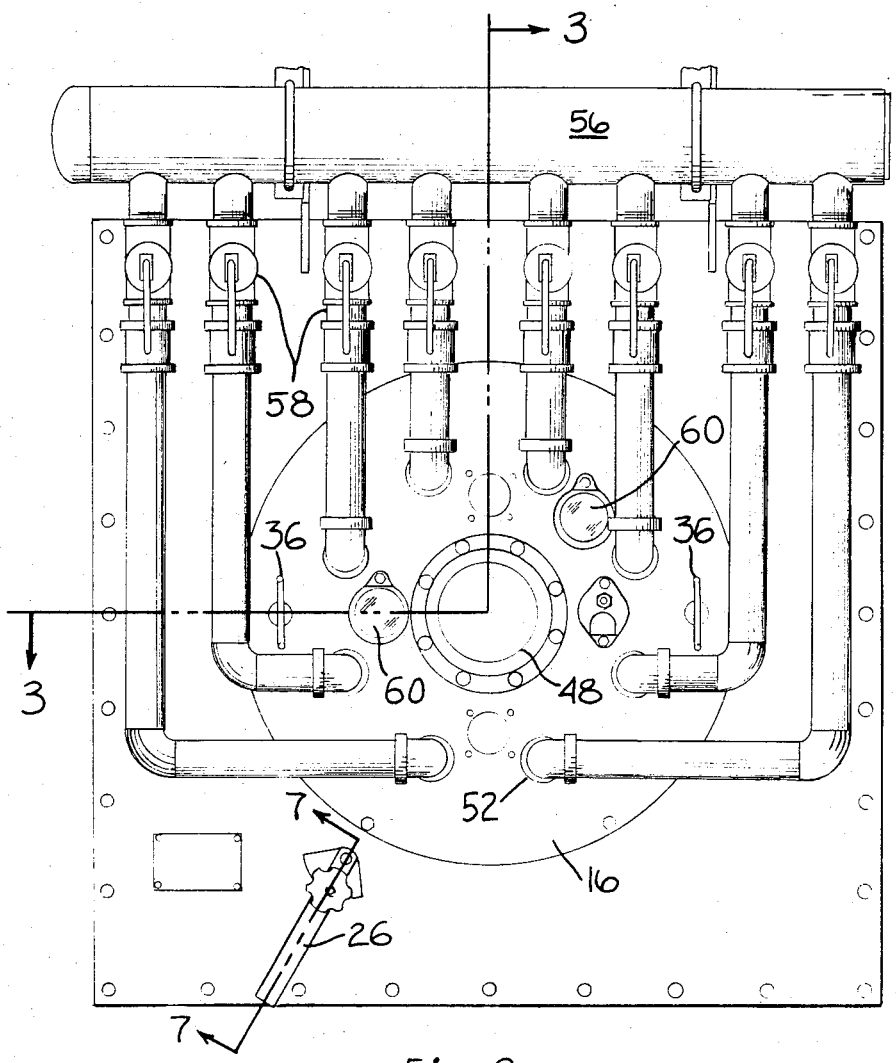
FIG. 2 is a rear view of a preferred embodiment of the low excess air burner of the present invention illustrating the fuel inlets, observation ports and the louver control handle.
Figure 1:
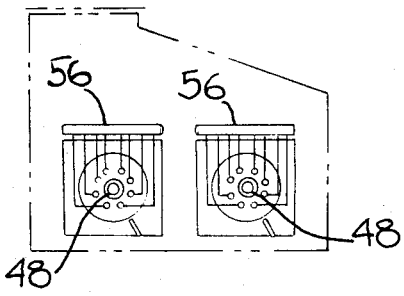
FIG. 1 is a plane view of a preferred embodiment of a pair of the low excess air burners of the present invention shown inside a typical windbox illustrated in phantom lines.

Second supply means may consist of one or more pipes 52 located a distance from the axis of the burner housing 12 and lying parallel thereto. The pipes 52 may be spaced generally equal distance from each other and lay generally in a circle having its center at the axis of the burner. The second supply pipes 52 enter the second end 16 of the burner housing and protrude beyond the first end 14 of the burner housing terminating at a distal end 54 within the refractory throat 15. As shown in FIG. 2, there may be eight second supply pipes 52 which are supplied from a gas inlet 56, each of the pipes 52 having a valve 58 for shutting off the flow of gas to the burner.

Referring now with particular reference to the low excess air burner illustrated in FIG. 4, first fuel supply means may consist of a pipe 48 located about and extending along the axis of the burner housing 12, entering the second end 16 of the burner housing and protruding beyond the first end 14 of the burner housing terminating at a distal end 50 in the refractory throat 15. First fuel supply means may additionally consist of a pipe 49 located adjacent the pipe 48 and extending parallel thereto, entering the second end 16 of the burner housing and protruding beyond the first end 14 of the burner housing 12 terminating at a distal end 50 in the refractory throat 15.

Second supply means may consist of one or more pipes 52 located a distance from the axis of the burner housing 12 and lying parallel thereto. The pipes 52 may be spaced generally equal distance from each other and lay generally in a circle having its center at the axis of the burner. The second supply pipes 52 enter the second end 16 of the burner housing and protrude beyond the first end 14 of the burner housing terminating at a distal end 54 within the refractory throat 15. Referring to FIG. 2, there may be eight second supply pipes 52 which are supplied from a gas inlet 56, each of the pipes 52 having a valve 58 for shutting off the flow of gas to the burner.

Figure 5:
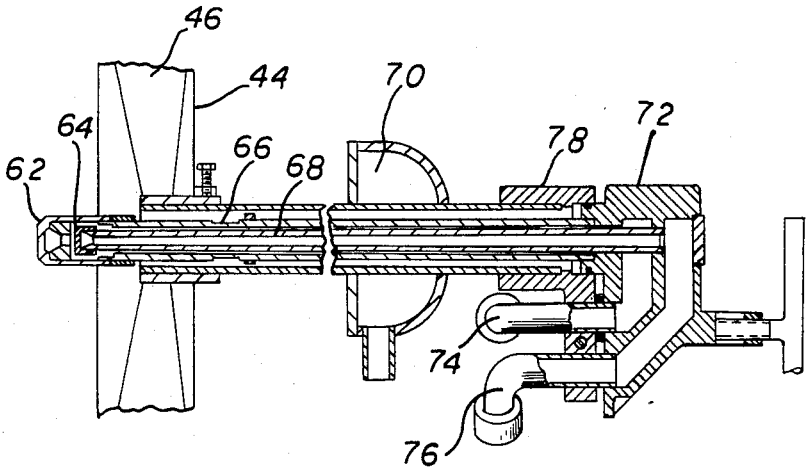
FIG. 5 is a cross sectional side view of one of the fuel atomizers of the low excess air burner.
Figure 9:
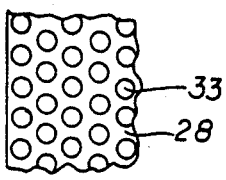
Figure 6:
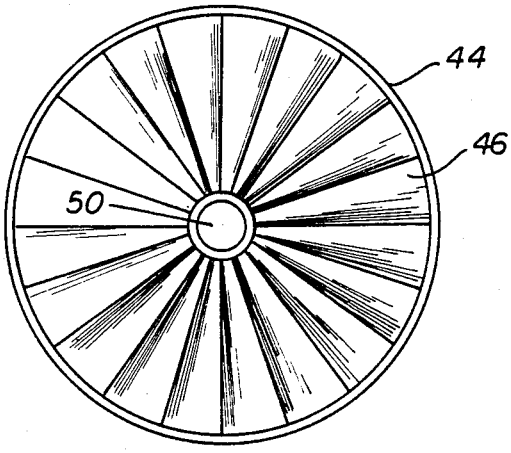
FIG. 6 is a front plane view of the air spinner of the present invention.

The first supply means consisting of pipes 48 and 49 may comprise oil atomizers as shown in FIG. 5 having a spray head 62, an atomizer 64, an oil tube 66, a steam tube 68, an aspirating air chamber 70 and an atomizer body 72. The atomizer may be fitted with an oil inlet 74 and a steam inlet 76 attached to the oil atomizer by the coupler body 78.

Observation ports 60 are provided in the rear wall of the burner to facilitate viewing of the flame shape and length for guidance in adjusting the position of the venturi which is also accomplished using the handles 36 at the rear wall of the burner to adjust the air flow through the air inlet 20 and thereby control the flame shape and length at high loads and trim the air flow at low loads.

The foregoing specification sets forth the invention in its preferred, practical forms but the structure shown is capable of modification within a range of equivalents without departing from the invention which is to be understood is broadly novel as is commensurate with the appended claims.

The embodiments of the invention in which an exclusive property or privilege is claimed are defined as follows:

1. A low excess air burner assembly comprising:

a hollow burner housing having a first end and a second end, the first end being open and adapted to be supported adjacent a refractory throat, the second end being closed, means for supplying fluid fuel to the refractory throat, air access means for introducing air into the burner housing adjacent the second end thereof, venturi means provided in the burner housing, air spinner means adjacent the first end of the burner housing, said venturi means comprising an annular insert formed by a first frustoconical member having a large end and a small end, a cylindrical member connected to said small end of said first frustoconical member, a second frustoconical member having a large end and a small end, the small end being connected to said cylindrical member, said venturi extending from a position adjacent said air spinner means to a position adjacent said air access means, means for moving the venturi means through a predetermined range to obstruct air from said air access means thereby reducing the flow of air through said burner to said opening, said venturi means being adapted to provide a substantially smooth, evenly distributed flow of air from said air access means to said air spinner means which causes turbulent flow of the air thereby providing substantially optimum mixing of the low excess air and fluid fuel in the refractory throat, one said large end of said venturi means being disposed adjacent said air access means, said air access means being adapted to admit a smooth evenly distributed flow of air through said venturi to said refractory throat.

2. The low excess air burner assembly recited in claim 1 wherein the air access means comprises an opening in the burner housing, means for controlling the flow of air through the opening.

3. The low excess air burner assembly recited in claim 2 wherein the means for controlling the flow of air through the opening in the burner housing comprises adjustable louvers.

4. The low excess air burner assembly recited in claim 3 further comprising a lever arrangement attached to the louvers whereby the louvers are manually adjustable.

5. The low excess air burner assembly recited in claim 2 further comprising an inlet housing around the opening in the burner housing providing a passage into the burner housing.

6. The low excess air burner assembly recited in claim 2 further comprising a perforated plate shield over the air access means in the burner housing providing a smooth evenly distributed air supply to the burner housing.

7. The low excess air burner assembly recited in claim 1 wherein the means for moving the venturi means comprises wheels rotatably attached to the venturi means, the wheels being adapted to roll on the lower surface of the burner housing, a rod being attached to the venturi means and extending rearwardly through the rear wall of the burner housing and terminating in a handle, the handle being adapted to move the venturi through a predetermined range of positions.

8. The low excess air burner assembly recited in claim 8 wherein a second rod is attached to said venturi and extending rearwardly through the rear wall of the burner housing and terminating in a second handle, the second handle being adapted to move the venturi through a predetermined range of positions whereby said first large end of said first frustoconical member overlies a part of said air access means whereby the flow of air to said venturi is reduced.

9. A low excess air burner comprising:

a cylindrical burner housing having a first end and a second end, the first end being open and adapted to be supported adjacent an opening in a refractory wall, the second end being closed by a closure plate, means for supplying fluid fuel to the opening in the refractory wall, air access means on said burner housing to admit air into the housing adjacent the second end thereof, the air access means comprising an opening in the burner housing near the second end thereof, an inlet housing around the air access means and extending outwardly therefrom providing a passageway into the burner housing, a perforated plate shield overlying the inlet housing, louvers disposed within the inlet housing to control the flow of air through the opening, venturi means provided in the burner housing along the length thereof, said venturi means comprising an annular insert comprising a first frustoconical member having a large end adjacent said air access means, a small end, a cylindrical member connected to said small end of said first frustoconical member, a second frustoconical member having a small end connected to said cylindrical member and extending from a position adjacent said air spinner means to a position adjacent said air access means, means for moving the venturi means through a predetermined range to overlie said air access means thereby reducing the flow of air through said burner to said opening, air spinner means adjacent the first end of the housing whereby the air access means admits a smooth, evenly distributed flow of air to the venturi in a smooth, evenly distributed flow of air flowing substantially the length of the burner housing through said venturi to the air spinner means which causes turbulent flow of the air thereby providing optimum mixing of the air and fluid fuel through the refractory throat.

10. The low excess air burner assembly recited in claim 9 further comprising a lever arrangement attached to the louvers whereby said louvers are adjustable.

11. The low excess air burner assembly recited in claim 9 wherein the venturi means comprises an annular insert having a reducing frustoconical surface adjacent an expanding frustoconical surface, and a cylindrical surface between said frustoconical surfaces, the three surfaces being combined to form a venturi.

12. The low excess air burner assembly recited in claim 9 wherein the means for moving the venturi means comprises wheels rotatably attached to the venturi means, the wheels being adapted to roll on the inner surface of the burner housing, a rod being attached to the venturi means and extending rearwardly through the rear wall of the burner housing and terminating in a handle, the handle being adapted to move the venturi through a predetermined range of positions.

13. The low excess air burner assembly recited in claim 9 wherein a second rod is provided, the rod being attached to the venturi and extending rearwardly through the rear wall of the burner housing and terminating in a handle, the handle being adapted to move the venturi through a predetermined range of positions.

14. A low excess air burner comprising a cylindrical burner housing having a first end and a second end, the first end being open and adapted to be supported adjacent an opening in a refractory wall, the second end being closed by a closure plate, means for supplying fluid fuel to the refractory throat, air access means in the housing adjacent the second end thereof, venturi means provided in the burner housing along the length thereof, means for moving the venturi means through a predetermined range to overlie said air access means thereby reducing the flow of air through said burner, said venturi means comprising a first hollow frustoconical member having an apex end and a base end, a second frustoconical member having an apex end and a base end, cylinder shaped means connecting said apex ends together forming an expanding surface and a reducing surface with said cylindrical shaped means therebetween, the means for moving the venturi means comprising wheels rotatably attached to the venturi means, the wheels being adapted to roll on the lower surface of the burner housing, a rod being attached to the venturi means and extending rearwardly through the rear wall of the housing and terminating in a handle, the handle being adapted to move the venturi through a predetermined range of positions overlying a part of said air access means, air spinner means adjacent the first end of the housing whereby the air access means admits a smooth, evenly distributed flow of air to the housing, the smooth, evenly distributed flow of air being adapted to move through said venturi means providing a smooth even flow to the air spinner means whereby turbulent flow of the air is provided thereby providing optimum mixing of the low excess air and fluid fuel in the opening in the refractory wall.

15. The low excess air burner assembly recited in claim 14 wherein the air access means comprises an opening in the burner housing, means for controlling the flow of air through the opening.

16. The low excess air burner assembly recited in claim 15 wherein the means for controlling the flow of air through the opening in the burner housing comprises adjustable louvers.

17. The low excess air burner assembly recited in claim 16 further comprising a lever attached to the adjustable louvers whereby they are adjustable.

18. The low excess air burner assembly recited in claim 14 further comprising an inlet housing around the air access means providing a passage into the burner housing.

19. The low excess air burner assembly recited in claim 14 further comprising a perforated plate shield over the air access means providing a smooth evenly distributed air supply to the burner housing.

20. The low excess air burner assembly recited in claim 14 wherein a second rod is provided, the second rod being attached to the venturi means and extending rearwardly through the rear wall of the housing and terminating in a handle, the handle being adapted to move the venturi through a predetermined range of positions.

* * * * *